US006446278B1

(12) United States Patent
Lin

(10) Patent No.: US 6,446,278 B1
(45) Date of Patent: Sep. 10, 2002

(54) ADJUSTABLE HOLDER DEVICE FOR SHOWER NOZZLE OR THE LIKE

(76) Inventor: Han Chun Lin, P.O. Box 63-99, Taichung 406 (TW)

( * ) Notice: Subject to any disclaimer, the term of this patent is extended or adjusted under 35 U.S.C. 154(b) by 0 days.

(21) Appl. No.: 09/942,689

(22) Filed: Aug. 31, 2001

(51) Int. Cl.[7] ..... A47K 7/04
(52) U.S. Cl. ..... 4/615
(58) Field of Search ..... 4/615; 248/205.5, 248/206.5, 288.31, 309.4

(56) References Cited

U.S. PATENT DOCUMENTS 2,216,149 A * 10/1940 Weiss ..... 4/615
4,461,439 A * 7/1984 Rose
5,495,884 A * 3/1996 Shikler

FOREIGN PATENT DOCUMENTS

DE 2 109 642 * 10/1971 ..... 4/615
FR 1 109 492 * 1/1956 ..... 4/615

* cited by examiner

*Primary Examiner*—Charles R. Eloshway

(57) ABSTRACT

An adjustable holder device for holding and attaching an object to a supporting wall member includes a holder member for supporting the object, and a sucker member for movably securing the holder member to the wall member. The sucker member may be moved or adjusted relative to the wall member to any suitable position, and the holder member may be magnetically secured to the sucker member and may be rotated or adjusted relative to the sucker member to any suitable or selected angular position. A cover may be engaged and press the sucker member against the wall member.

7 Claims, 10 Drawing Sheets

ADJUSTABLE HOLDER DEVICE FOR SHOWER NOZZLE OR THE LIKE

BACKGROUND OF THE INVENTION

1. Field of the Invention

The present invention relates to a holder, and more particularly to an adjustable holder device for shower nozzle or the other objects.

2. Description of the Prior Art

As shown in FIG. 1 a typical holder for shower nozzle comprises a holder member 12 secured onto a wall member 80 or the like with one or more fasteners 121, and including a socket 13 formed or provided therein for receiving the handle 11 of a shower nozzle 10 or the like. It is required to drill one or more holes in the wall member 80 before the holder member 12 may be secured onto the wall member 80. The holes may spoil the outer appearance of the wall member 80. Furthermore, the wall member 80 is typically applied with tiles thereon which may not be easily drilled with holes by the users themselves, and which are normally required to be drilled with the holes by experts. In addition, once the holder member 12 is secured onto the wall member 80, it will be difficult to move or adjust the holder member 12 relative to the wall member 80. Furthermore, the shower nozzle 10 also may not be rotated or adjusted relative to the wall member 80.

The present invention has arisen to mitigate and/or obviate the afore-described disadvantages of the conventional holders for shower nozzles.

SUMMARY OF THE INVENTION

The primary objective of the present invention is to provide an adjustable holder device for shower nozzle or the other objects and for allowing the shower nozzle to be moved or adjusted relative to the wall member to the other suitable heights.

The other objective of the present invention is to provide an adjustable holder device for shower nozzle or the other objects and for allowing the shower nozzle to be rotated or adjusted relative to the wall member to the other suitable angular positions.

In accordance with one aspect of the invention, there is provided an adjustable holder device for holding and attaching an object to a supporting wall member, the adjustable holder device comprising a holder member for supporting the object, and means for movably securing the holder member to the wall member. The holder member may be moved or adjusted relative to the wall member to any suitable position, and may be rotated or adjusted relative to the wall member to any suitable or selected angular position.

The holder member includes at least one fastener strap attached thereto for securing the object to the holder member, or includes a socket opening formed therein for receiving the object and for securing the object to the holder member.

The movably securing means includes a sucker member for detachably and movably securing to the wall member, and/or a device for magnetically attracting the holder member to the sucker member and for allowing the holder member and thus the object to be rotated or adjusted relative to the sucker member or the wall member to the other suitable or selected angular positions. The sucker member may be disengaged from the wall and may be moved or adjusted to the other position or height of the wall member for moving and adjusting the object or the shower nozzle to any suitable position of height of the wall member.

The magnetically attracting device includes at least one magnet attached to the holder member or attached to the sucker member for magnetically attracting the holder member to the sucker member.

The magnetically attracting device includes a canopy for engaging onto the wall member and having the magnet attached thereon, and means for fixing the sucker member in the canopy.

A cover is further provided and secured between the sucker member and the canopy and engaged on the sucker member for securing the sucker member on the wall member.

The canopy includes a middle portion having the magnet secured thereon, and/or includes a seat provided on the middle portion thereof, and the magnet is secured on the seat.

The sucker member includes an outer peripheral portion, the cover includes an outer peripheral skirt engaged with the outer peripheral portion of the sucker member for pressing and securing the sucker member on the wall member and for further solidly securing the sucker member on the wall member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
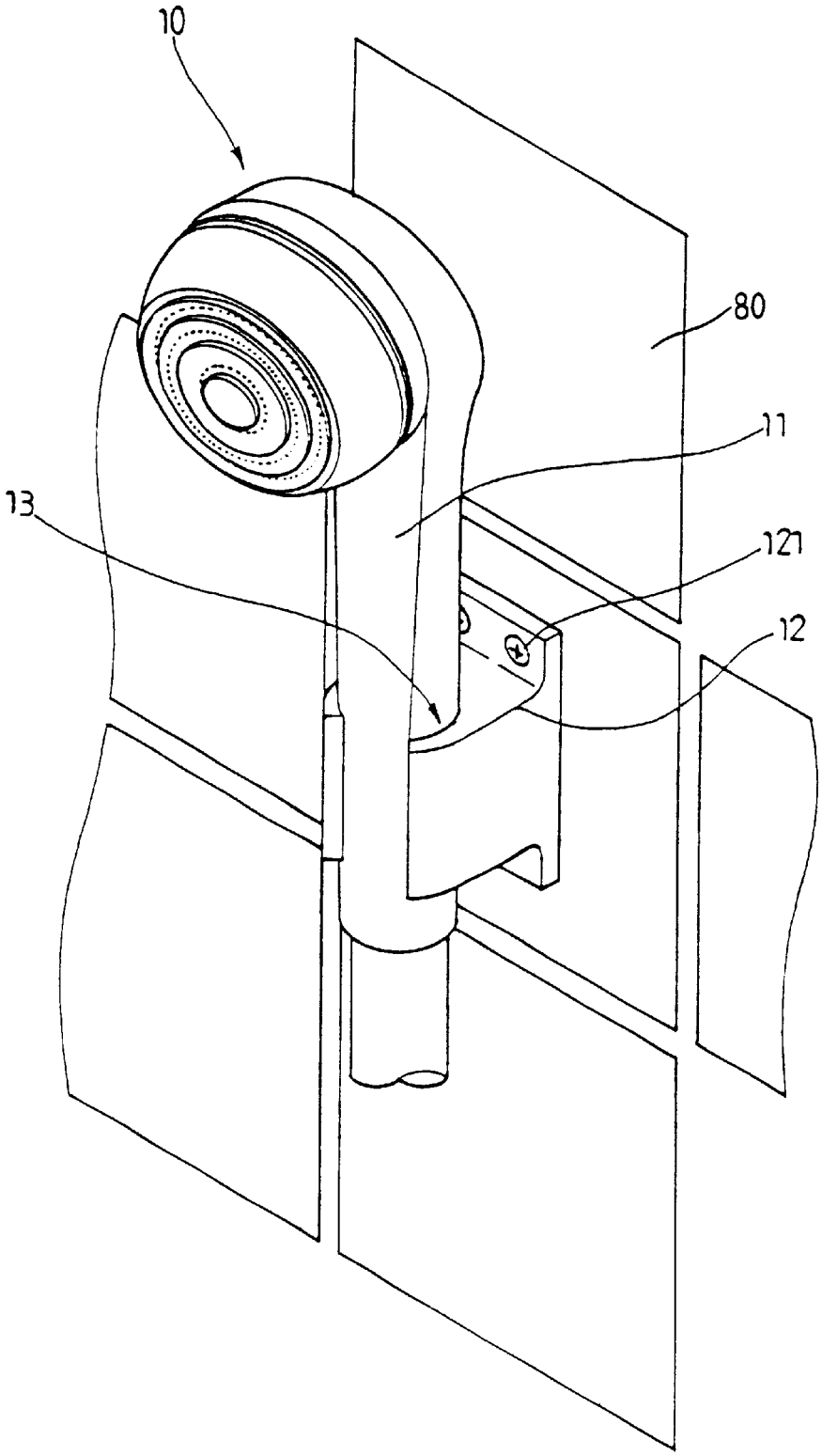
FIG. 1 PRIOR ART
FIG. 1 is a perspective view showing a typical holder device for shower nozzle.
Figure 2:
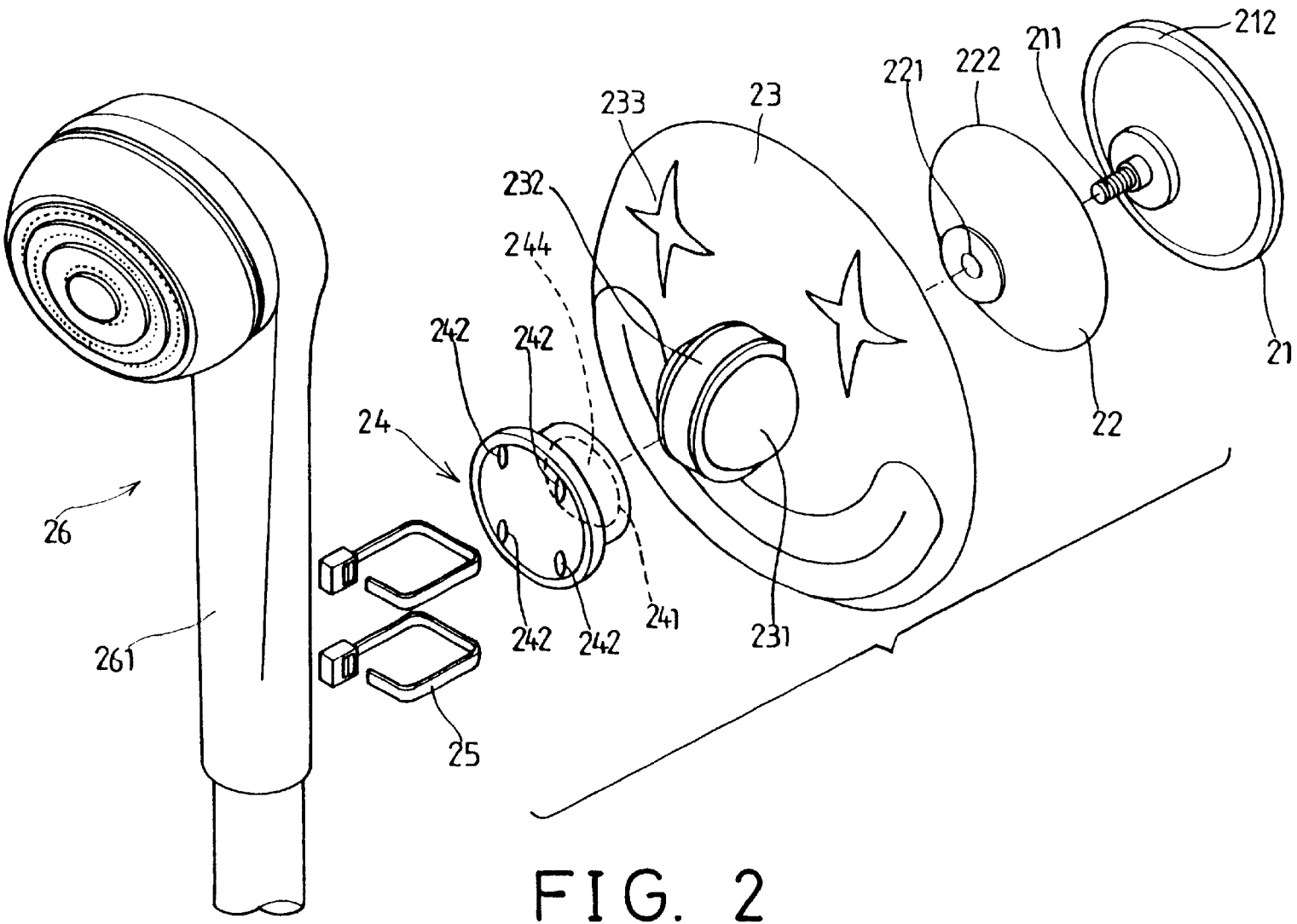
FIG. 2 is an exploded view of an adjustable holder device for shower nozzle or the other objects in accordance with the present invention.
Figure 3:
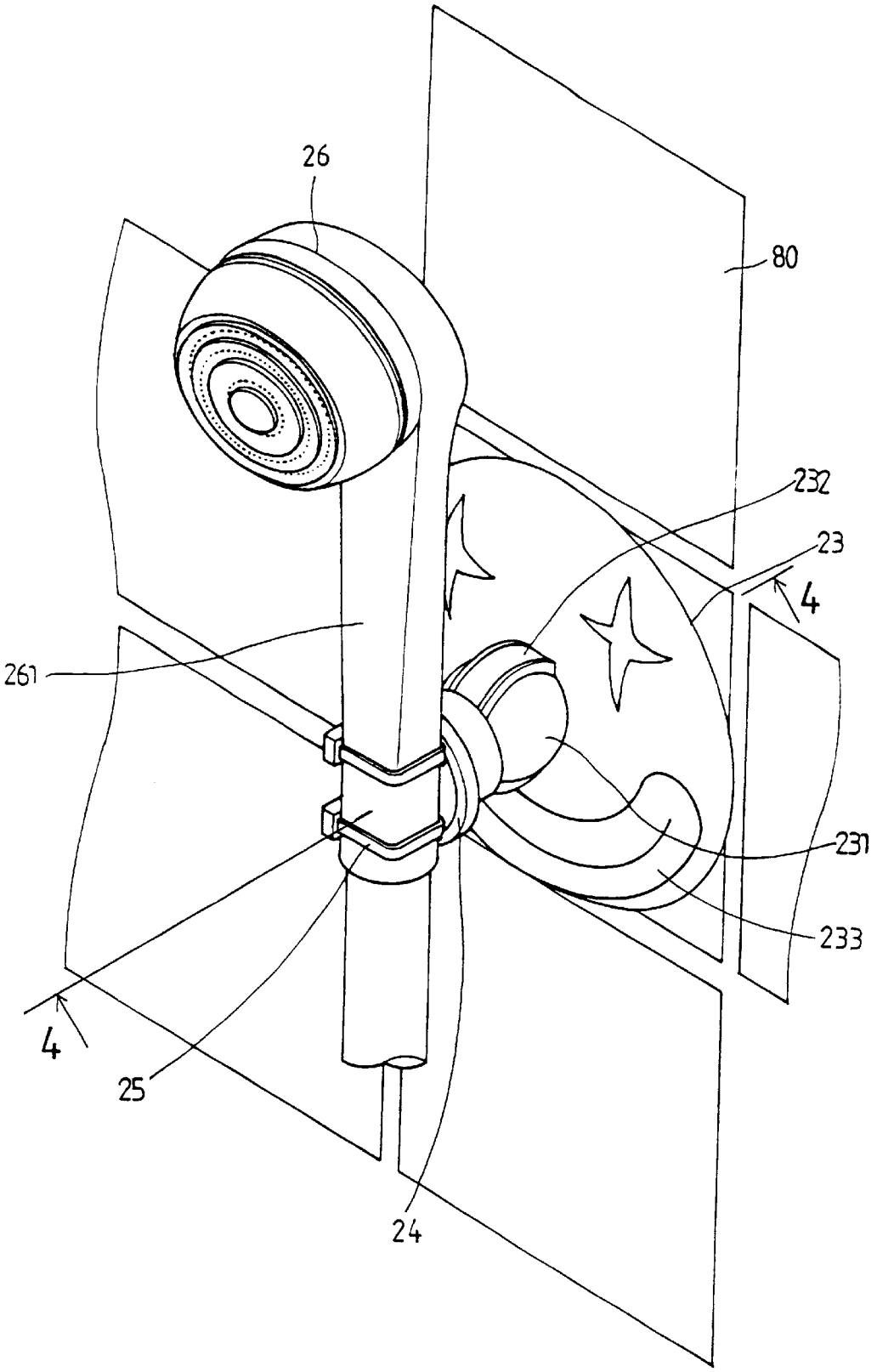
FIG. 3 is a perspective view of an adjustable holder device.
Figure 4:
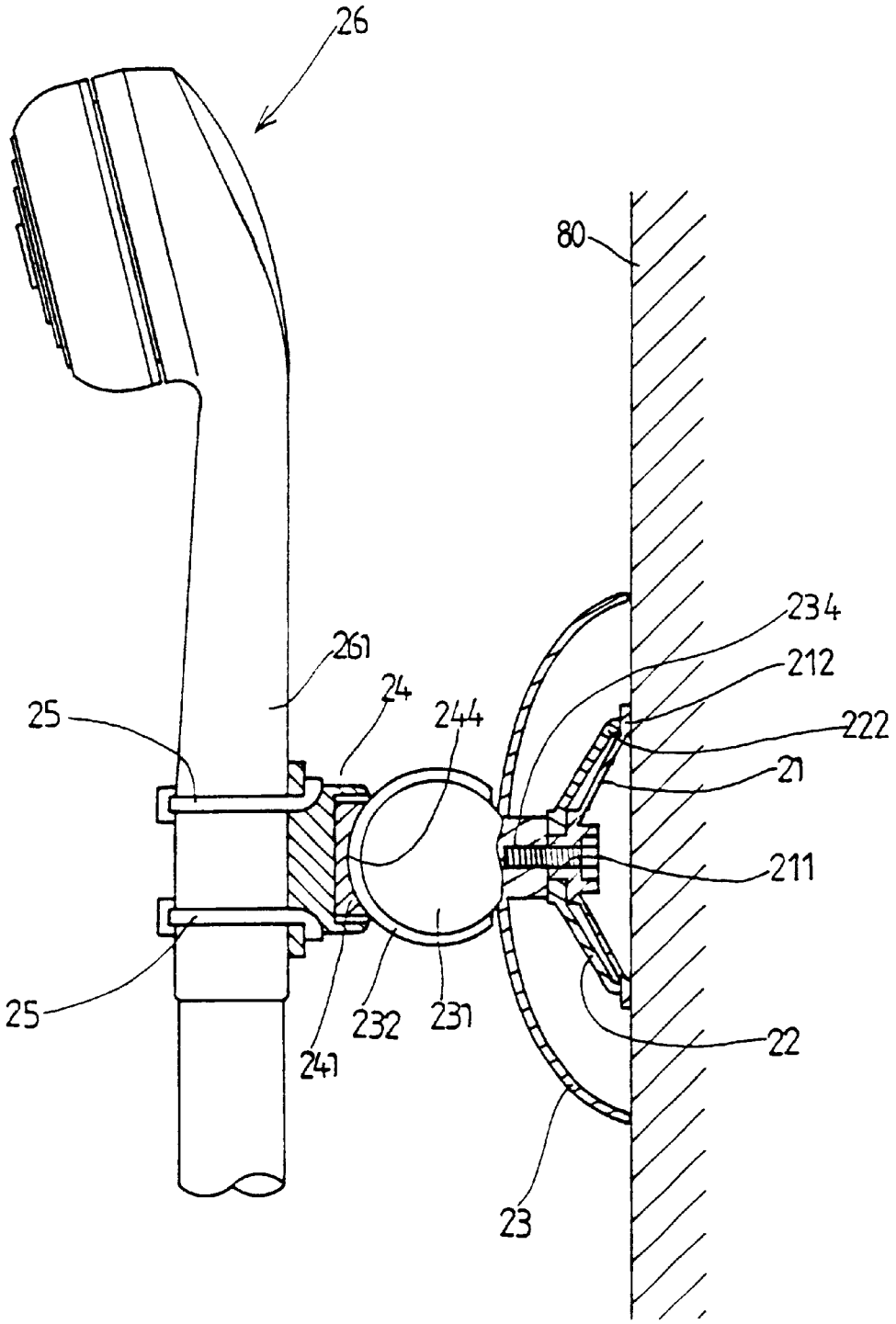
FIG. 4 is a cross sectional view taken along lines 4—4 of FIG. 3.

Referring to the drawings, and initially to FIGS. 2–4, an adjustable holder device for shower nozzle or the other objects in accordance with the present invention comprises a sucker member 21 including a fastener 211, such as a bolt 211 extended therefrom or secured thereto. particularly secured to the middle or the center portion thereof. The sucker member 21 is preferably made or rubber, soft or the other resilient materials, and includes an outer peripheral skirt 212 for engaging with the wall member 80 that the sucker member 21 is to be attached thereon. A cover 22 is engaged on the sucker member 21, and includes an aperture 221 formed therein for receiving the fastener 211 therein, and includes an outer peripheral skirt 222 for engaging with the outer peripheral skirt 212 of the sucker member 21, and for pressing and positioning the outer peripheral skirt 212 of the sucker member 21 against the wall member 80.

A canopy 23 includes a curved or a semi-spherical shape and is preferably made of rubber, plastic or the other resilient materials that may be slightly deformed or compressed. A ball or a seat, such as a spherical seat 231 is extended or provided on the front or outer portion of the canopy 23, particularly provided on the middle or the center portion thereof. and includes a pattern 233 provided on the front or the outer portion thereof for decorative purposes. For example, the seat 231 may be formed as the spatial nose of the pattern 233. The canopy 23 includes a screw hole 234 formed therein (FIGS. 4, 5) for threading the fastener,211 and for detachably securing the sucker member 21 and the cover 22 in the canopy 23.

Figure 5:
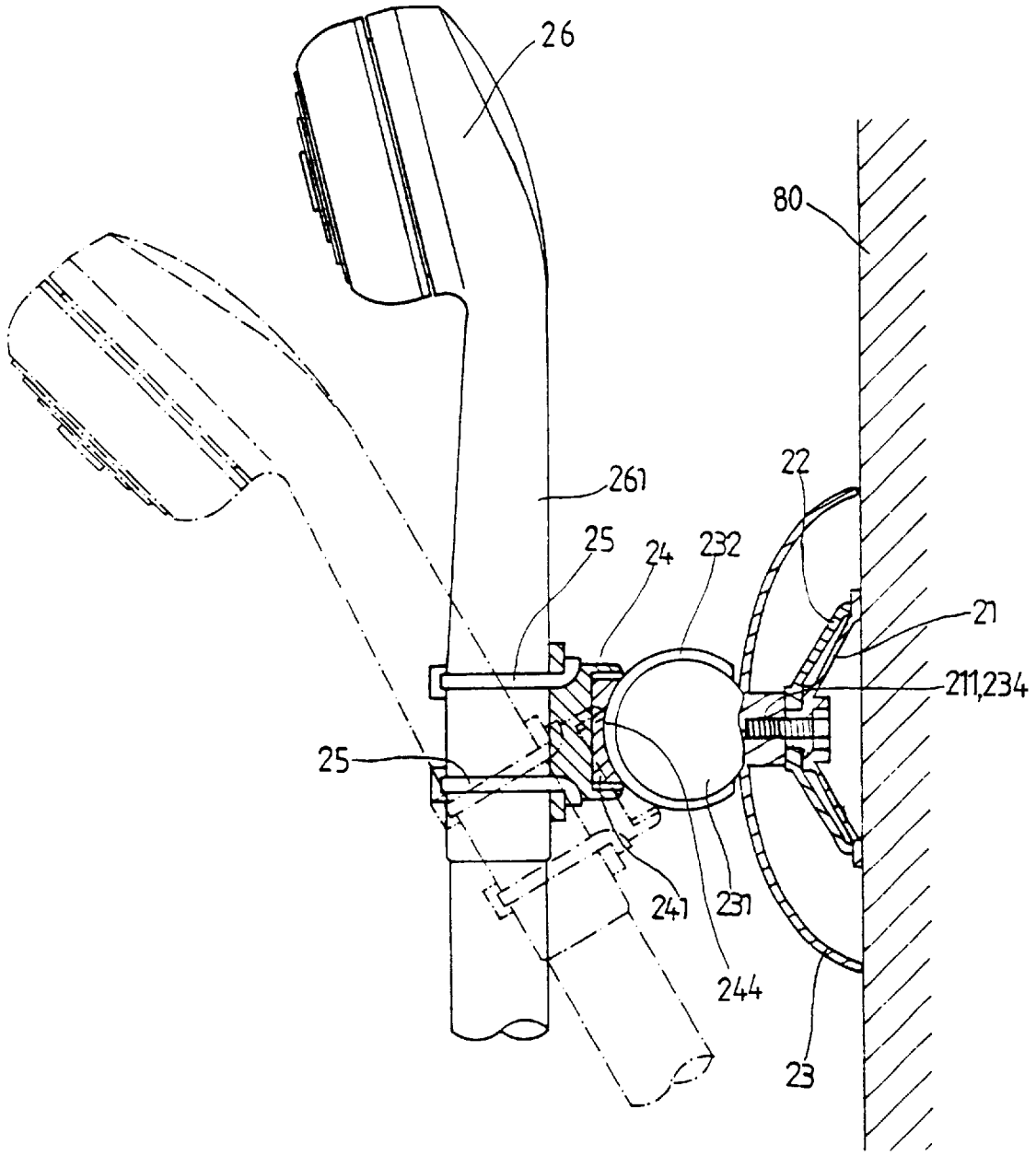
FIG. 5 is a cross sectional view similar to FIG. 4, illustrating the operation of the adjustable holder device for shower nozzle or the other objects.

In operation, as shown in FIGS. 4, 5, the sucker member 21 may be forced or depressed toward or against the wall member 80 by pressing the canopy 23 against the wall member 80. The canopy 23 may be unthreaded relative to the fastener 211 of the sucker member 21 for separating the middle or the center portions of the sucker member 21 and the cover 22 and the canopy 21 from each other, and for allowing the middle or the center portion of the sucker member 21 to be further depressed toward or against the wall member 80 by the canopy 23. The outer peripheral skirt 222 of the cover 22 may further press and position the outer peripheral skirt 212 of the sucker member 21 against the wall member 80. The canopy 23 may also be unthreaded and disengaged from the sucker member 21 for allowing the sucker member 21 to be disengaged from the wall member 80 by such as a typical protrusion (not shown) that is extended from the outer peripheral skirt 212 of the sucker member 21.

Figure 6:
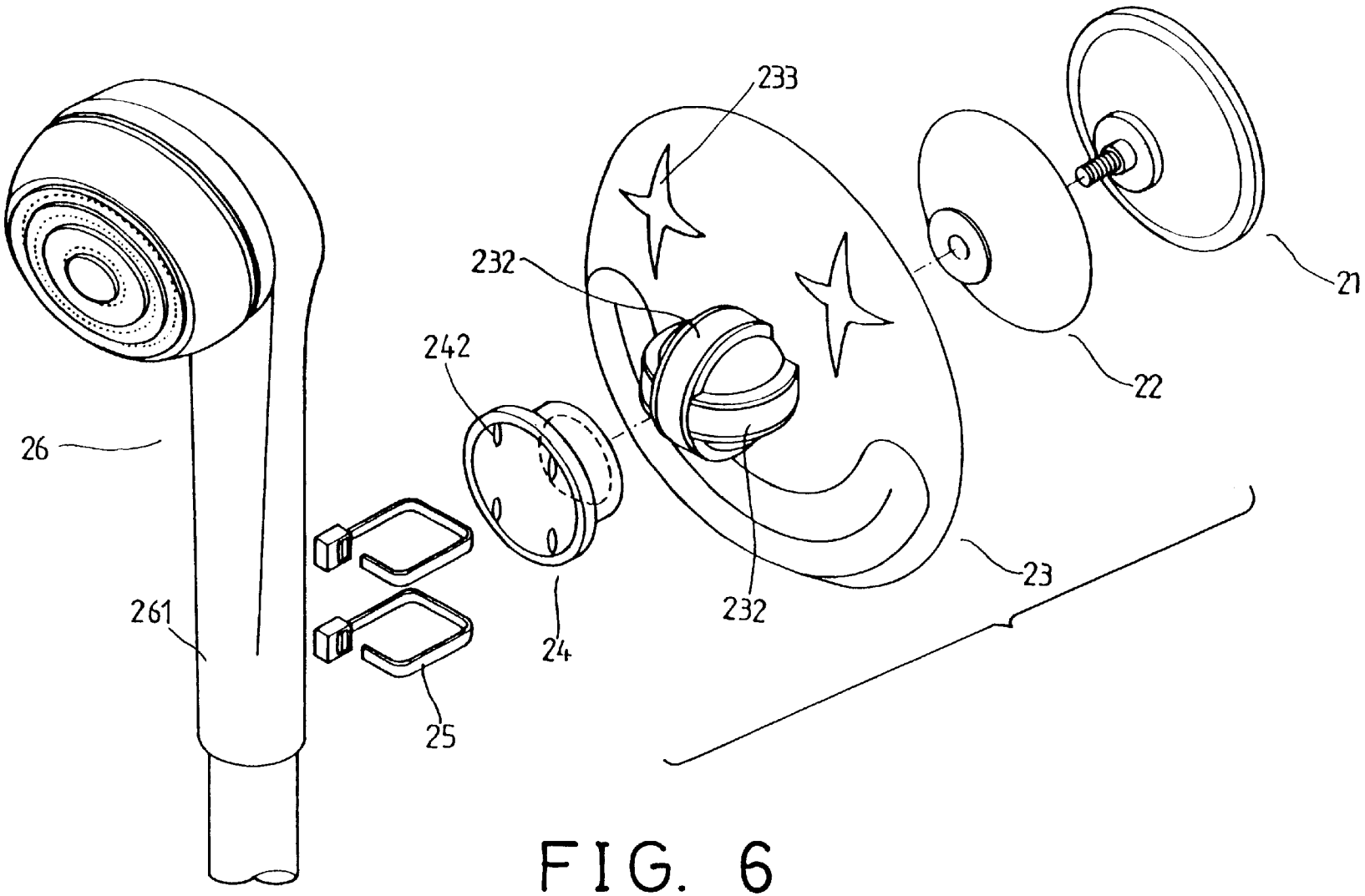
FIGS. 6, 7, 8, 9, 10 are exploded views similar to FIG. 2, illustrating the other embodiments or arrangements of the adjustable holder device for shower nozzle or the other objects.
Figure 7:
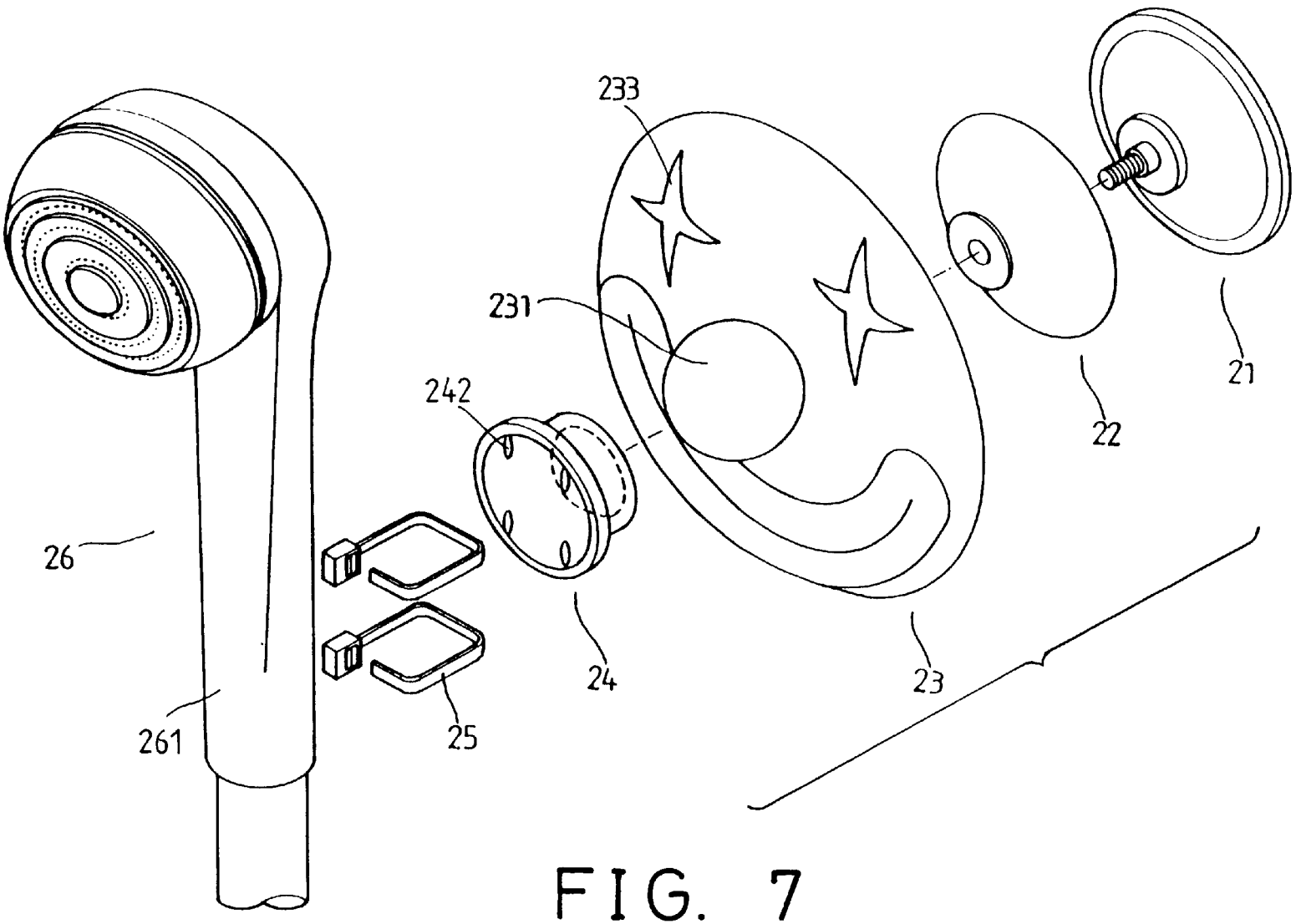

The seat 231 of the canopy 23 may be made of magnetic materials (FIG. 7). Alternatively, the seat 231 of the canopy 23 may include one (FIGS. 2–5, and 8–10) or more (FIG. 6) magnets or magnetic members 232 applied or attached or secured thereon for magnetically attracting or securing a holder member 23 thereon. The holder member 24 may also be made of magnetic materials, or may include one or more magnets or magnetic members 241 applied or attached or secured therein for magnetically attracting or engaging with the magnetic members 232 or the seat 231 of the canopy 23. The magnetic member 241 of the holder member 24 preferably includes a curved recess 244 formed therein for receiving the corresponding curved outer peripheral surfaces of the magnetic members 232 or the seat 231 of the canopy 23, and for allowing the holder member 24 to be rotated relative to the seat 231 to any suitable or selected angular position relative to the wall member 80 (FIG. 5).

Figure 8:
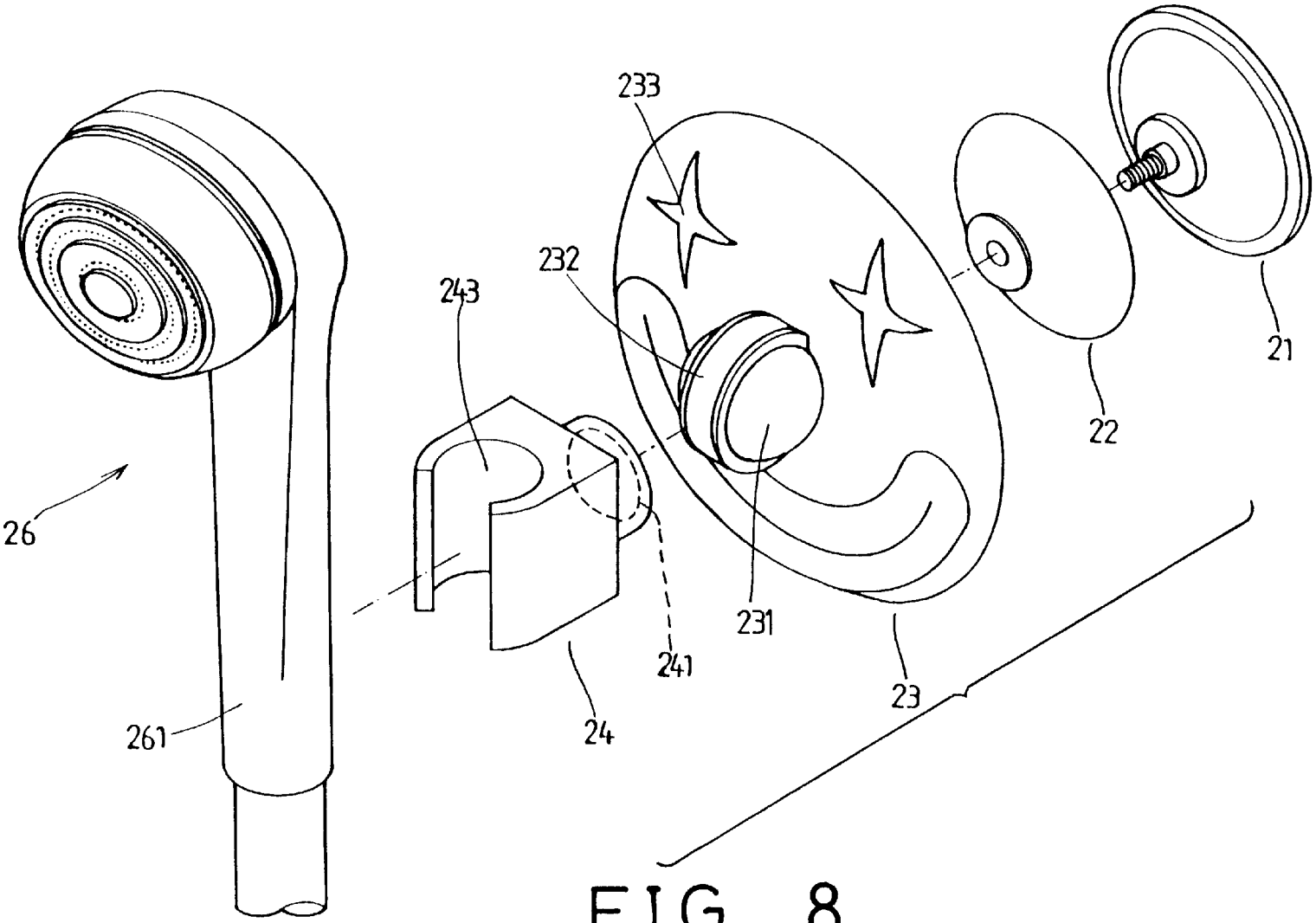
Figure 9:
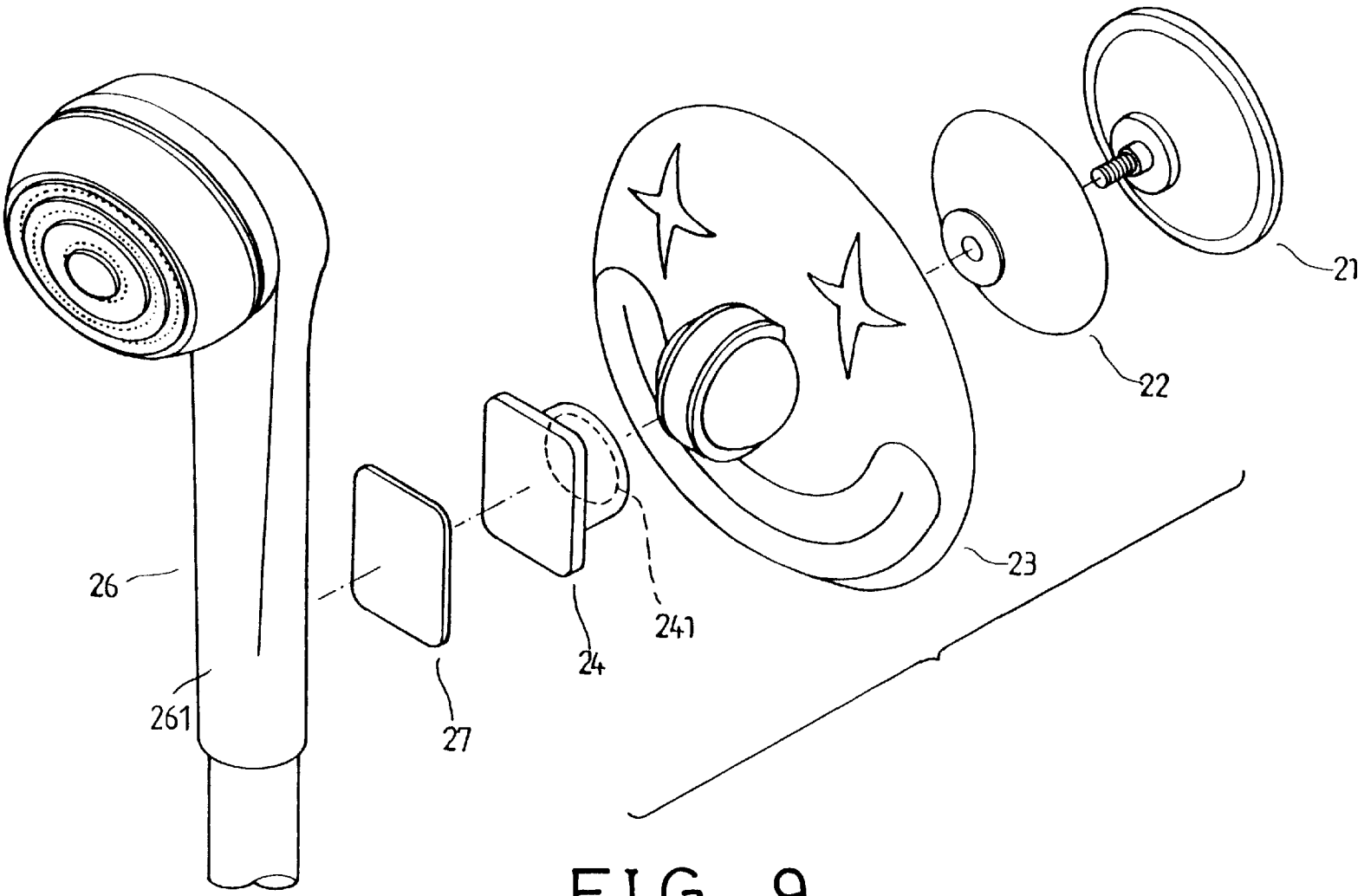
Figure 10:
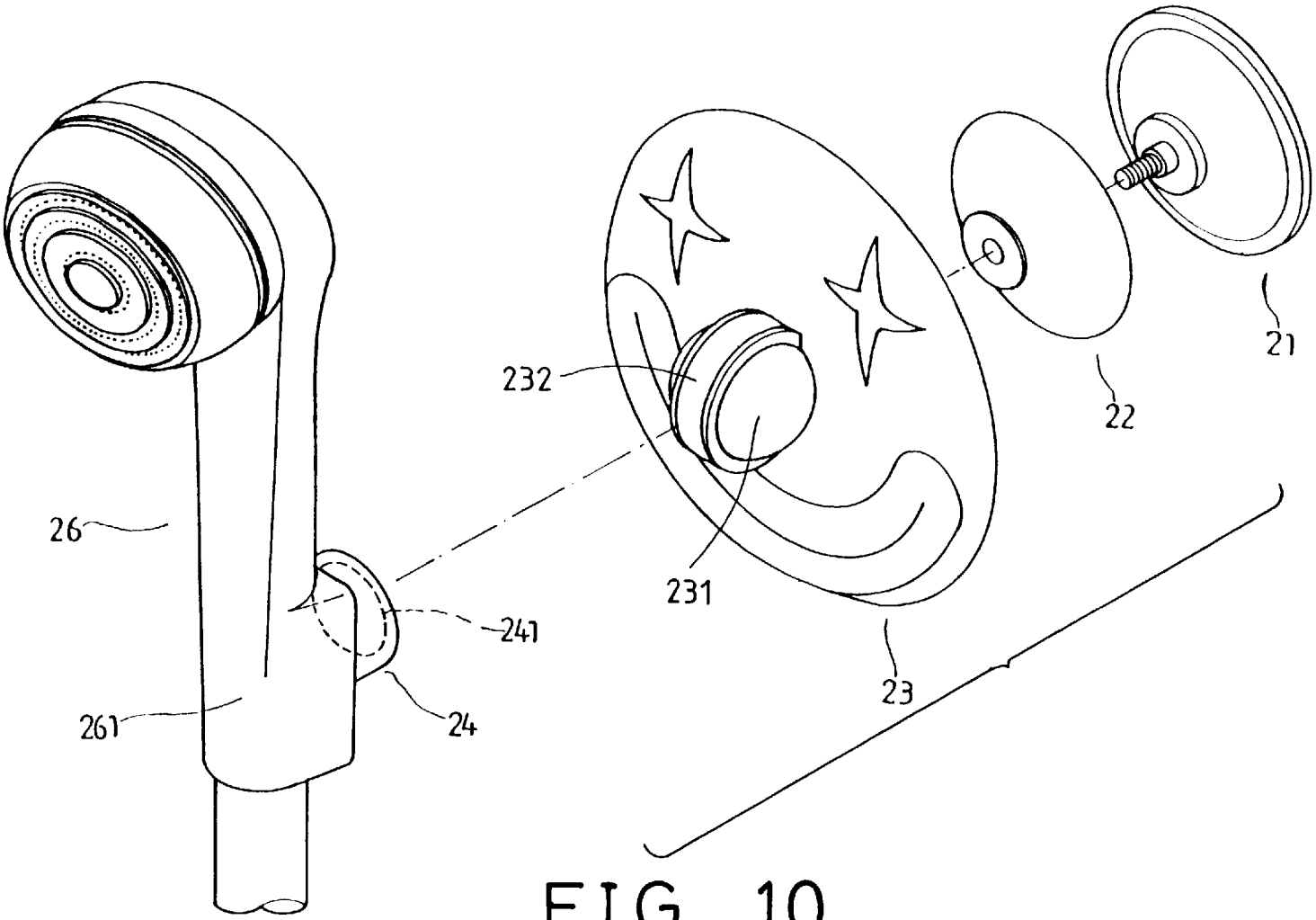

As shown in FIGS. 2–7, the holder member 24 includes one or more orifices 242 formed or provided therein for threading with fastener straps 25 thereto which may secure or fasten the shower nozzle 26, particularly the handle 261 of the shower nozzle 261 to the holder member 24. Alternatively, as shown in FIG. 8, the holder member 24 may includes a socket opening 243 formed therein for detachably receiving the handle 261 of the shower nozzle 26. Further alternatively, as shown in FIG. 9, the holder member 24 may includes an adhesive material 27 for securing the handle 261 of the shower nozzle 26 to the holder member 24. Still further alternatively, as shown in FIG. 10, the handle 261 of the shower nozzle 26 may include the holder member 24 attached or provided thereon for allowing the shower nozzle 26 to be directly attached to the seat 231 or the magnetic members 232 of the canopy 23 by the magnetic member 241 of the holder member 24.

In operation, as shown in FIG. 5, the shower nozzle 26 may be rotated or adjusted relative to the canopy 23 and/or the wall member 80 to any suitable or selective angular positions easily by rotating the holder member 24 relative to the seat 231 and/or the magnetic members 232 of the canopy 23. The sucker member 21 may be secured onto the wall member 80 without drilling any hole in the wall member 80, and may be moved or adjusted relative to the wall member 80 to any suitable or required position. The holder member 24 and the seat 231 themselves may be made of magnetic materials for allowing the holder member 24 and the seat 231 to be attracted or secured together. Alternatively, the holder member 24 and the seat 231 may also be attracted or secured together with the magnetic members 241 and 232. The cover 22 may further be provided for solidly securing and positioning the sucker member 21 onto the wall member 80. The holder member 24 may be made of metal or magnetically attractable materials for being secured to the seat 231 by the magnetic seat 231 or by the magnetic members 232. Alternatively, the seat 231 of the canopy 23 may also be made of metal or magnetically attractable materials for being secured to holder member 24 the magnetic member 241.

Accordingly, the adjustable holder device for shower nozzle or the like in accordance with the present invention may be used for moving or adjusting the shower nozzle relative to the wall member to the other suitable heights, and/or for rotating the shower nozzle relative to the wall member to the other suitable angular positions.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable holder device for holding and attaching an object to a supporting wall member, said adjustable holder device comprising:

a holder member for supporting the object, a sucker member for detachably and movably securing to the wall member, a spherical and magnetic seat for magnetically attracting said holder member and for allowing said holder member and the object to be rotated relative to said spherical and magnetic seat, a canopy including a screw hole formed therein, said spherical and magnetic seat being secured on said canopy, and a fastener secured to said sucker member, and threaded with said screw hole of said canopy for securing said sucker member to said canopy and said spherical and magnetic seat.

2. The adjustable holder device according to claim 1 further comprising a cover secured between said sucker member and said canopy, and engaged on said sucker member for securing said sucker member on the wall member.

3. The adjustable holder device according to claim 2, wherein said sucker member includes an outer peripheral portion, said cover includes an outer peripheral skirt engaged with said outer peripheral portion of said sucker member for pressing said sucker member against the wall member.

4. The adjustable holder device according to claim 1 further comprising at least one magnetic member attached onto said spherical and magnetic seat, for magnetically attracting said holder member to said spherical and magnetic seat.

5. The adjustable holder device according to claim 1, wherein said holder member includes at least one fastener strap attached thereto for securing the object to said holder member.

6. The adjustable holder device according to claim 1, wherein said holder member includes a socket opening formed therein for receiving and for securing the object to said holder member.

7. The adjustable holder device according to claim 1, wherein said holder member further includes at least one magnet for magnetically attracting said holder member to said seat.

* * * * *